US006014777A

United States Patent [19]

Gupton

[11] Patent Number: 6,014,777

[45] Date of Patent: Jan. 18, 2000

[54] UROLOGICAL ACCESS UNDERGARMENT

[76] Inventor: Kenneth Gupton, 9535 Fairmead Dr., Charlotte, N.C. 28269

[21] Appl. No.: 09/103,893

[22] Filed: Jun. 24, 1998

Related U.S. Application Data

[60] Provisional application No. 60/050,621, Jun. 24, 1997.

[51] Int. Cl.[7] ..... A41B 9/00

[52] U.S. Cl. ..... 2/400; 2/403

[58] Field of Search ..... 2/400–408, 114, 2/227, 228, 238; 602/67–72

[56] References Cited

U.S. PATENT DOCUMENTS

| | | | |
|---|---|---|---|
| 2,477,593 | 8/1949 | Gershenow | 2/408 |
| 4,145,763 | 3/1979 | Abrams et al. | 2/403 |
| 4,300,241 | 11/1981 | Shaull . | |
| 4,446,575 | 5/1984 | Davis . | |
| 4,597,110 | 7/1986 | Smith . | |
| 4,637,078 | 1/1987 | Southwell | 2/408 |
| 4,644,589 | 2/1987 | Pettis | 2/403 X |
| 4,675,918 | 6/1987 | O'Brien | 2/402 |
| 4,835,795 | 6/1989 | Lonon | 2/408 |
| 5,103,501 | 4/1992 | Meisels | 2/114 X |
| 5,546,608 | 8/1996 | Russano | 2/408 |

*Primary Examiner*—Gloria M. Hale

[57] ABSTRACT

A shorts-type undergarment with two vertical openings on the front of the shorts. The first opening, 4, is located at the bottom of the crotch and extends upward. This opening, 4, allows for the insertion of a catheter. The second opening, is an access panel, 1, which is opened by pulling back a long vertical strip of Velcro®, 3, attached to a corresponding strip of oppositely mated Velcro®, 2, which horizontally extends partially across one front side. The patient is able to retain a high degree of modesty and dignity, when the catheter is attended to by medical personnel. Since the catheter is secured, in a straight pathway, there is a decreased likelihood the patient will develop secondary medical complications like urinary tract infections, discomfort and irritation associated with a catheter which is not properly secured.

1 Claim, 1 Drawing Sheet

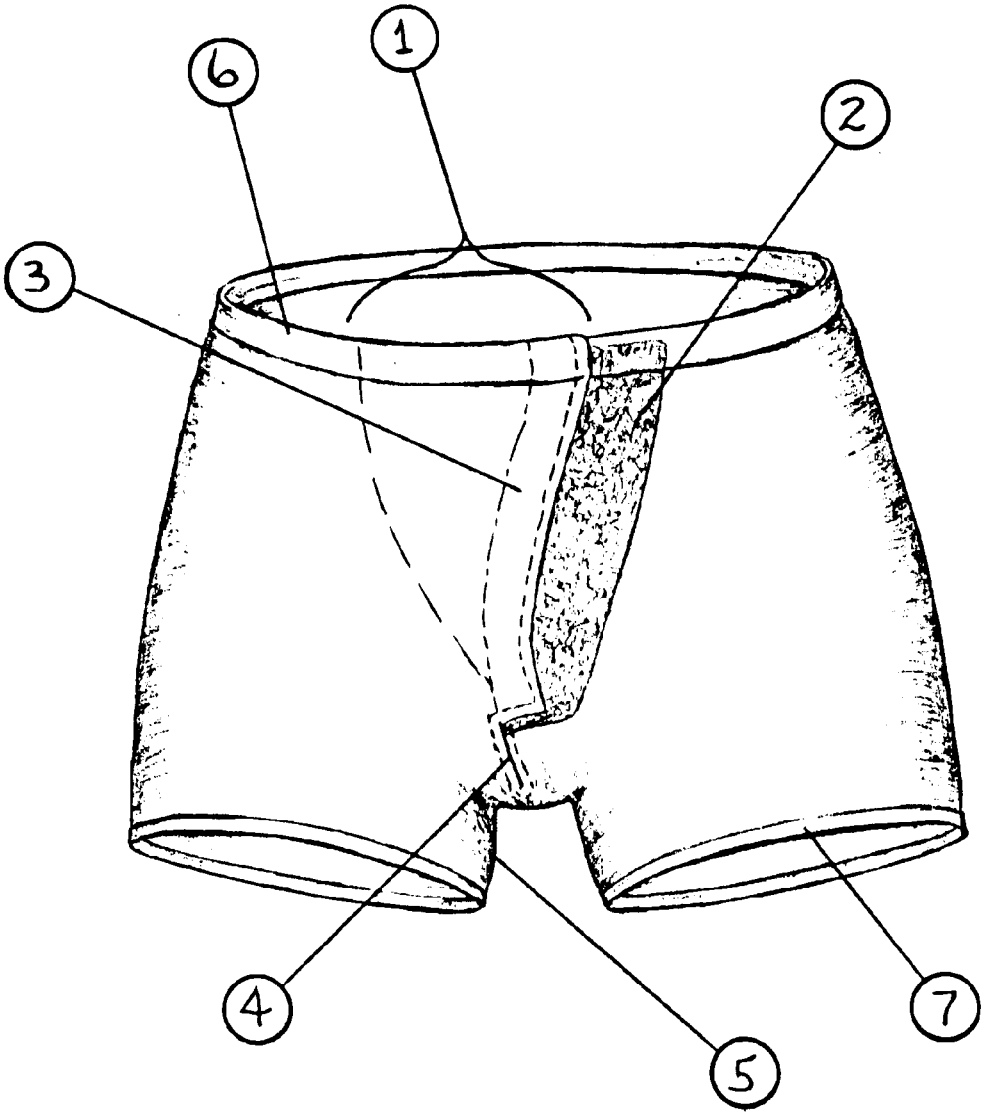
1
2
3
4
5
6
7

UROLOGICAL ACCESS UNDERGARMENT

This application claims the benefit of U.S. Provisional Appln. No. 60/050,621 filed Jun. 24, 1997.

BACKGROUND

1. Field of Invention

This invention relates to a one-piece undergarment which provides easy access to the crotch area for examination, or treatment, by medical personnel when the patient is catheterized. It affords the patient a sense of dignity and modesty by allowing them to wear an undergarment while catheterized and during examination and maintenance by medical personnel. The design has the additional effect of keeping the catheter securely aligned, in a straight path, to avoid harmful sideways movement. This movement creates irritation and increased risk of urinary tract infections.

2. Description of Prior Art

Heretofore many different arrangements were used to provide access to the crotch region. There is a specific need for an undergarment which allows medical personnel easy access to the crotch area, for catheterization purposes, and the patient to maintain his sense of modesty and dignity. The prior art contains examples of this concept but fails to produce the desired result due to the necessity of removing the entire frontal panel of the undergarment. This results in exposing the entire genital and anal area to the public. Another unique need, not addressed by the prior art, is the necessity of maintaining a secure straight pathway for the catheter thus reducing irritation and increased risk of urinary tract infections. The following is a discussion of these arrangements and their drawbacks:

One arrangement involved simply having an open crotch portion with no covering. Shaull U.S. Pat. No. 4,300,241 (1981) is specifically designed for use by female patients undergoing gynecological examinations. Although suitable for this limited purpose, the opening is much too small to allow medical personnel sufficient access to the crotch area to safely insert a catheter and sanitize the area during routine hygiene maintainence. Additionally, the open design does not afford the patient any degree of privacy because the opening can not be closed.

Another arrangement, shown in Smith U.S. Pat. No. 4,597,110 (1986) demonstrates a panty-type undergarment with a horizontal opening at the bottom of the crotch. This invention is not intended to be accessed by medical personnel and does not have a separate opening for the insertion of a catheter.

Davis U.S. Pat. No. 4,446,575 (1984) utilizes a narrow vertical opening in the rear of the undergarment. Its purpose, like Shaull, is to provide an access panel for a medical examination purposes, specifically, a proctological examination. It would not be functional for access to the frontal crotch region for catheterization.

Abrams U.S. Pat. No. 4,145,763 (1979) attempts to solve the problem of dual access to the front and back portions of the crotch area. It utilizes two completely separable cloth panels secured by Velcro® tabs. During examination, either tab can be completely removed or rolled up and secured to accommodate access. Unfortunately, the horizontal fastening tabs, at the base of the crotch area, can not be raised very high. This necessitates the unfastening of the side Velcro® tabs which exposes the entire genital area and buttocks of the patient.

Russano U.S. Pat. No. 5,546,608 (1996) also employs Velcro® tabs to secure the undergarment. However, like Abrams, it uses many small tabs which are secured to the outside of the garment. Again, like Abrams, the entire undergarment opens up completely but Russano is constructed of one-piece. When the garment is raised, the entire genital area and buttocks of the patient are exposed. This is due to the fact that it is specifically designed for a physically handicapped person whose crotch region is difficult to access. This undergarment employs a flap, located at the bottom of the groin area, which can be raised for the insertion of a catheter. The disadvantage of having a flap in this area is the increased sanitation risk of providing a ready medium on which the discharge of urine and other bodily fluids will collect.

Like Russano, Southwell U.S. Pat. No. 4,637,078 (1987) is specifically designed for the handicapped. It is also a one-piece undergarment whose front and back crotch portions disconnect. This allows a long one piece undergarment to be opened up completely. Unfortunately, this exposes the entire crotch region exposing the entire genital area and buttocks of the patient. It employs a hook and loop fastening means which connects a triangular shaped panel fitted into a V-shaped notch. Along one side of the notch, a long slit runs at a 45 degree angle into which a catheter may be placed. This is a disadvantageous position for insertion of a catheter. It promotes side-ways movement of the catheter and can cause irritation and further medical urinary problems.

OBJECTS AND ADVANTAGES

Accordingly, several objects and advantages of my invention are to provide a straight secure path into the crotch area, for insertion of a catheter. Easy access to the crotch area, for sanitation and medical purposes, is achieved without changing the straight insertion path of the catheter. The patient is truly given a sense of dignity and modesty by not having his entire crotch and buttocks area exposed during treatment.

Medically, it is extremely important for the catheter to be stationary and enter the patient from a straight and secure path. If it shifts from side to side, irritation will occur and the catheter may have to be removed. This promotes skin irritation and infections. My invention securely guides the catheter through a straight vertical slit at the bottom of the crotch region to prevent these problems. Another advantage is the retention of this secure opening during sanitation and medical procedures. This is due to the fact of a separate vertical slit, above the opening, which is utilized for these purposes. This allows the catheter to remain stationary while the crotch area is accessed.

This long vertical slit is easily opened by two opposing Velcro® tabs. In one simple motion, as opposed to opening many small tabs, the undergarment is opened from the front. This exposes the catheter. It may then be inserted, removed or the area sanitized. Because the urinary tract is involved, there is a frequent and important need to routinely sanitize the genital area to prevent infections. This necessitates frequent maintenance by medical personnel. The positioning of the opening mechanism, directly above the catheter opening, versus on the side, reduces the likelihood that the catheter will shift sideways and cause irritation. Additionally, it provides instantaneous access for routine observation of the catheter by medical personnel or the patient.

Another advantage is the overwhelming sense of dignity and modesty the patient is afforded by this unique design. Other patents claim this feature but still expose the buttocks, rectum, scrotum and other genital areas when the undergarment is unfastened. My invention positions the bottom of the vertical access panel directly above the vertical slit for the catheter. It continues to run to the very top of the undergarment. This allows the medical personnel to completely expose the front crotch area for catheterization and sanitation. During this process, the buttocks, rectum, scrotum and other genital areas are covered. Additionally, it also allows the patient to easily and modestly check his catheter without talking off his undergarment.

The universal application of my invention is another advantage of the prior art. It is not limited to the handicapped or one sex. It is designed for universal application to any person requiring catheterization.

BRIEF DESCRIPTION OF THE DRAWING

FIG. 1 is front view demonstrating the placement of crotch slit opening and the, hook and loop fastener, VELCRO® fastening system.

SUMMARY

My invention is an undergarment which provides easy access to the crotch area for patients requiring catheterization. The unique design and placement of the access panel, directly above the slit, reduces the irritation caused by the catheter. Because the panel is secured by just two tabs of passive and aggressive, hook and loop fastener, VELCRO®, vertically positioned, the catheter may be inspected without promoting side-way movement. During this inspection, and at all other times, the slit firmly holds the catheter in a safe and secure line of entry to the urinary tract. The slit is vertically positioned at the base of the crotch beneath the bottom of the access panel. The positioning of the access panel affords the patient a high level of modesty when the crotch area is exposed.

PREFERRED EMBODIMENT—DESCRIPTION

Operation and use of the undergarment is simple and straightforward. It has two vertical openings located on the front of the undergarment to accommodate the insertion of a catheter and provide access to the crotch region. It may be utilized in many settings, including hospitals, nursing homes and home care. The material is cotton but may be made from any other material suitable for this purpose.

In FIG. 1, the side of the access panel, 1, which is pulled away from the undergarment, has a long vertical strip of aggressive, hook and loop fastener, VELCRO®, 3. This strip, 3, is mated with a corresponding strip of passive, hook and loop fastener, VELCRO®, 2, to hold the access panel firmly in place. The passive, hook and loop fastener, VELCRO® strip, 2, extends horizontally across the front side of the undergarment, several inches, to accommodate sizing of smaller or larger individuals. The bottom of the, hook and loop fastener, VELCRO® strips stops several inches from the bottom of the crotch region. Located, vertically, directly below the access panel is a slit, 4, which runs to the bottom of the crotch region. This strip, 4, is the insertion point for a catheter. Beneath the crotch, located on both sides, are tubular trunk legs, 5, seamed by an elastic band, 7. A matching elastic waistband, 6, is located at the top of the undergarment.

CONCLUSIONS, RAMIFICATIONS AND SCOPE

It can be seen that, according to the invention, the undergarment has two vertical openings on the front. The access panel employs the use of two, hook and loop fastener, VELCRO® strips, passive and aggressive, to gain access and closure of the panel. Said panel being located directly above the second vertical slit which allows insertion of a catheter. The unique placement of the two slits, the access panel being directly above the catheter slit, provides many advantages for the patient. These advantages include decreased risk of irritation from side-ways movement, decreased risk of urinary tract infection, easy access to the crotch region and a great sense of modesty for the patient while the catheter is being serviced.

Although the description above contains many specificities, these should not be construed as limiting the scope of the invention but a merely providing illustrations of some of the presently preferred embodiments of this invention. Various other embodiments and ramifications are possible with it's scope.

Thus the scope of the invention should be determined by the appended claims and their legal equivalents, rather than by the examples given.

I claim:

1. An undergarment for hospital, nursing home and home-care use which comprises:

an undergarment having a front, rear, a waist and a crotch; said undergarment having a vertical catheter slit extending from a bottom of the crotch upward to a top of said crotch thereby allowing the insertion of a catheter, and a vertical access opening located and extending directly above said catheter slit to said waist and wherein said opening has two strips of mating corresponding passive and aggressive hook and loop fasteners to open and close said opening when said garment is worn.

* * * * *